US008019254B2

(12) United States Patent
Tatsumi et al.

(10) Patent No.: US 8,019,254 B2
(45) Date of Patent: Sep. 13, 2011

(54) TONER CONVEYING DEVICE, PROCESS CARTRIDGE, AND IMAGE FORMING APPARATUS

(75) Inventors: Kenzo Tatsumi, Osaka (JP); Koji Kato, Ibaraki (JP); Hirobumi Ooyoshi, Ibaraki (JP); Tomofumi Yoshida, Ibaraki (JP); Yoshihiro Kawakami, Hyogo (JP); Yoshiyuki Shimizu, Osaka (JP); Tomohiro Kubota, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 795 days.

(21) Appl. No.: 11/870,136

(22) Filed: Oct. 10, 2007

(65) Prior Publication Data

US 2008/0181692 A1 Jul. 31, 2008

(30) Foreign Application Priority Data

Oct. 13, 2006 (JP) ..... 2006-280139

(51) Int. Cl.
*G03G 15/08* (2006.01)
*G03G 21/12* (2006.01)

(52) U.S. Cl. ..... 399/120; 399/360

(58) Field of Classification Search ..... 399/120, 399/358, 360

See application file for complete search history.

(56) References Cited

U.S. PATENT DOCUMENTS

| | | | | |
|---|---|---|---|---|
| 5,887,224 | A | 3/1999 | Mizuishi et al. | |
| 6,904,249 | B2 * | 6/2005 | Kato et al. | 399/120 |
| 2002/0114651 | A1 * | 8/2002 | Wang | 399/358 |
| 2007/0104523 | A1 | 5/2007 | Yoshida et al. | |
| 2007/0140763 | A1 | 6/2007 | Shimizu et al. | |
| 2008/0089727 | A1 | 4/2008 | Shimizu et al. | |
| 2008/0095559 | A1 | 4/2008 | Shimizu et al. | |

FOREIGN PATENT DOCUMENTS

| | | |
|---|---|---|
| JP | 63-10424 | 3/1988 |
| JP | 4-333878 | 11/1992 |
| JP | 5-88549 | 4/1993 |
| JP | 5-107918 | 4/1993 |
| JP | 11-153901 | 6/1999 |
| JP | 2003295592 A * | 10/2003 |
| JP | 2003-345116 | 12/2003 |

OTHER PUBLICATIONS

Machine Translation of JP2003-295592A.*

Japanese Office Action Issued Apr. 26, 2011, in Patent Application No. 2006-280139.

* cited by examiner

*Primary Examiner* — David M Gray
*Assistant Examiner* — Gregory H Curran
(74) *Attorney, Agent, or Firm* — Oblon, Spivak, McClelland, Maier & Neustadt, L.L.P.

(57) ABSTRACT

A toner conveying device includes a toner hopper for containing unused toner, a waste-toner hopper for containing waste toner, and waste-toner conveying screws that convey waste toner in the waste-toner hopper. The waste-toner hopper is separated from the toner hopper by a flexible partition made of elastic material. The flexible partition is located near the conveying member, and includes a rigid body.

11 Claims, 9 Drawing Sheets

TONER CONVEYING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority document, 2006-280139 filed in Japan on Oct. 13, 2006.

BACKGROUND OF THE INVENTION

1. Field of the Invention

The present invention relates to a toner conveying device, a process cartridge, and an image forming apparatus.

2. Description of the Related Art

In electrophotographic image forming apparatuses, such as copiers, printers and facsimile machines, a latent image is formed on a photosensitive element, and is developed into a visible image with toner. Toner not used in developing the latent image remains on the photosensitive element as waste toner. Generally, such image forming apparatuses include a container for waste toner as well as one for fresh or new toner to be supplied. In recent years, from a viewpoint of space saving, a toner cartridge (toner bottle) has been proposed that is originally a fresh-toner container but serves also as a waste-toner container.

Japanese Patent Publication No. S63-10424 discloses a conventional technology related to a toner cartridge including a developer hopper, at a lower opening of which a developing roller is arranged. The toner cartridge is filled with toner, with a little space left at an upper portion. The space is separated from the developer hopper by a flexible partition, and has a toner collecting hole on a side wall. Waste toner is collected by a cleaner, and is conveyed by a toner conveying member located between the cleaner and the toner collecting hole into the space through the toner collecting hole. As fresh toner reduces with use, the flexible partition moves downward, and the space at the upper portion gradually increases. Waste toner is accumulated in this increasing space.

Japanese Patent Application Laid-Open No. H5-88549 discloses a conventional technology related to a developing device provided with a unit that integrally including a toner hopper that contains fresh toner to be supplied and a waste-toner container that contains waste toner collected from an image carrier. The toner hopper is separated from the waste-toner container by a partition made of flexible material to be deformable at least toward a toner hopper side.

Japanese Patent Application Laid-Open No. H11-153901 discloses a conventional technology related to a toner cartridge that integrally includes a fresh-toner container and a waste-toner container. The waste-toner container is arranged above the fresh-toner container, and separated from the fresh-toner container by a partition. The partition is made of flexible material so that it can deform towards the fresh-toner container.

However, with the conventional technologies, a stirring member and the like increases the internal pressure of the space containing toner. As a result, the flexible partition expands instead of hanging down, and contacts a waste-toner conveying screw to convey waste toner, thereby increasing torque or being caught in the screw.

SUMMARY OF THE INVENTION

It is an object of the present invention to at least partially solve the problems in the conventional technology.

According to an aspect of the present invention, a toner conveying device includes a first container that contains unused toner; a second container that contains waste toner; a conveying member that is located inside the second container, and conveys waste toner; and a flexible partition made of elastic material that is located near the conveying member, and separates the first container and the second container. The flexible partition includes a rigid body.

According to another aspect of the present invention, a toner conveying device includes a first container that contains unused toner; a second container that contains waste toner; a conveying member that is located inside the second container, and conveys waste toner; and a flexible partition made of elastic material that is located near the conveying member, and separates the first container and the second container. Any one of KYNAR (polyvinylidene fluoride) and toner is applied in advance to either one of the conveying member and the flexible partition.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
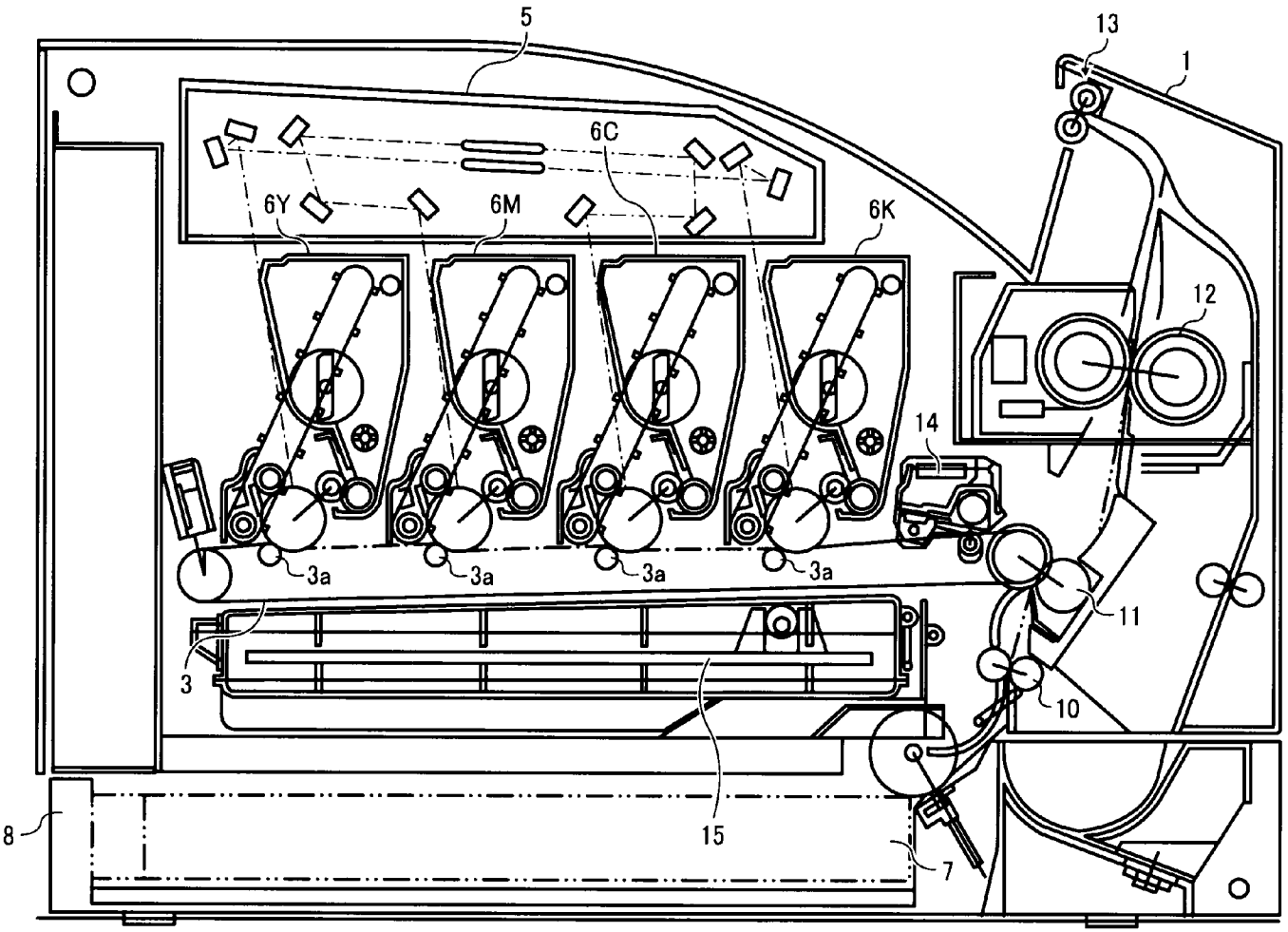
FIG. 1 is a schematic diagram of an image forming apparatus according to an embodiment of the present invention.

FIG. 1 is a schematic diagram of a color electrophotographic apparatus 1 as an image forming apparatus according to an embodiment of the present invention. The color electrophotographic apparatus 1 includes image forming units 6 (6Y, 6M, 6C, and 6K) for four different colors: yellow, magenta, cyan, and black (Y, M, C and K), and an exposure device 5 to form a latent image on a photosensitive drum (image carrier). The image forming units 6 (6Y, 6M, 6C, and 6K) are aligned in substantially a central part in the color electrophotographic apparatus 1, and the exposure device 5 is located above the image forming units 6. A secondary transfer device 11 and a cleaning device 14 are placed adjacent to a transfer belt 3. A waste-toner container 15 and a cassette 8 that contains recording sheets (recoding medium) 7 are arranged below the transfer belt 3. The recording sheet 7 that is fed by a sheet-feeding device 9 passes between the transfer belt 3 and the secondary transfer device 11, and is led to a fuser 12 so that a toner image is thermally fixed on the recording sheet 7.

Figure 2:
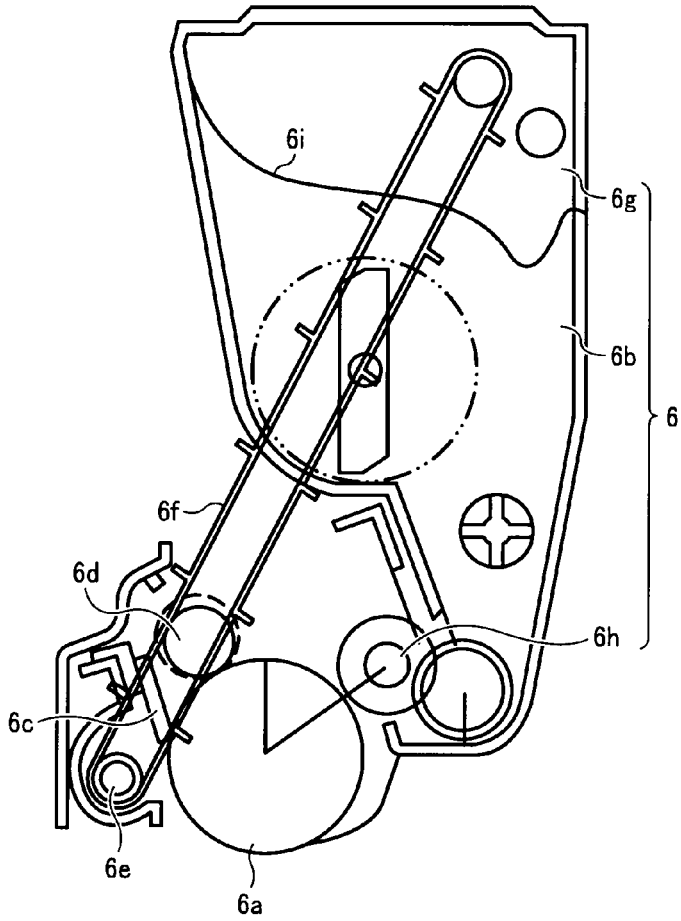
FIG. 2 is a schematic diagram of an image forming unit shown in FIG. 1.

FIG. 2 is a schematic diagram of the image forming units 6 (6Y, 6M, 6C, and 6K). The image forming units 6 (6Y, 6M, 6C, and 6K) are of like configuration, and thus but one of them is explained in detail. The image forming unit 6 includes a toner hopper 6*b* serving as a container for unused toner, and a photosensitive drum 6*a* serving as a latent image carrier. The toner hopper 6*b* contains coloring particles, i.e., toner. Around the photosensitive drum 6*a* are arranged a cleaning blade 6*c* that removes residual toner from the photosensitive drum 6*a* after primary transfer, and a charging roller 6*d* that abuts on the photosensitive drum 6*a*. The image forming unit 6 further includes a toner conveying screw 6*e*, a waste-toner conveying belt 6*f*, a waste-toner hopper 6*g*, and a developing roller 6*h*. The toner conveying screw 6*e* conveys removed toner, through the waste-toner conveying belt 6*f*, to the waste-toner hopper 6*g* so that waste toner is collected in the waste-toner hopper 6*g*. The toner hopper 6*b* and the waste-toner hopper 6*g* are separated by a flexible partition 6*i*.

An electrophotographic process is explained next. With reference to FIG. 2, the photosensitive drum 6*a* rotates by a driving device (not shown). The charging roller 6*d* uniformly charges to a high potential a photosensitive layer of the photosensitive drum 6*a*. The exposure device 5 selectively exposes the photosensitive layer uniformly charged to a high potential based on image data. This exposure reduces the potential, which creates a low-potential portion and a high-potential portion on the photosensitive layer, thereby forming an electrostatic latent image thereon. Subsequently, toner is transferred from the developing roller 6*h* with a thin toner layer formed thereon when the low-potential portion (or high-potential portion) of the electrostatic latent image comes into contact with the developing roller 6*h*, whereby the electrostatic latent image is developed into a toner image. After the primary transfer, the cleaning blade 6*c* that abuts on the photosensitive drum 6*a* cleans toner remaining on the surface of the photosensitive drum 6*a* for preparation of next image formation.

With reference to FIG. 1, a primary transfer roller 3*a* is located at a position where the image forming unit 6 contacts the transfer belt 3, and by applying a high potential to the primary transfer belt 3*a*, a potential difference is created between the photosensitive drum 6*a* and the transfer belt 3 to transfer the toner image formed on the photosensitive layer to the transfer belt 3. Toner image of different colors are sequentially transferred onto the transfer belt 3, and superimposed one upon another in the image forming units 6. Thus, on the transfer belt 3, a toner image of a plurality of colors is formed of single-color toner images. The recording sheet 7 including paper and an overhead projector (OHP) sheet is supplied to the secondary transfer device 11 from the sheet-feeding device 9 and a sheet-conveying device 10 at appropriate timing. By applying a high potential to the secondary transfer device 11, a potential difference is created between the transfer belt 3 and the secondary transfer device 11, and the toner image on the surface of the transfer belt 3 is transferred onto the recording sheet 7. The recording sheet 7 with the toner image thereon is separated from the transfer belt 3, and is sent to the fuser 12 so that the toner image is fused on the recording sheet 7. The recording sheet 7 is discharged to a sheet-discharge tray on the top surface of the color electrophotographic apparatus 1 by a sheet-discharge device 13.

The cleaning device 14 removes residual toner remaining on the surface of the transfer belt 3 after the toner image is transferred onto the recording sheet 7. The residual toner is collected in the waste-toner container 15. The transfer belt 3 that has been cleaned prepares for next transfer of a toner image.

By simplifying a conveyance route of the recording sheet 7 from feed to discharge, and by making a curvature radius of the conveyance route large, it is possible to prevent paper jam during the conveyance and to improve the reliability. In addition, this configuration facilitates an operation to solve paper jam, and can be applied to a color electrophotographic apparatus that handles various recording media including cardboard.

FIGS. 3A, 3B, 4A and 4B are schematic diagrams of a toner conveying device of the image forming unit 6.

Figure 3A:
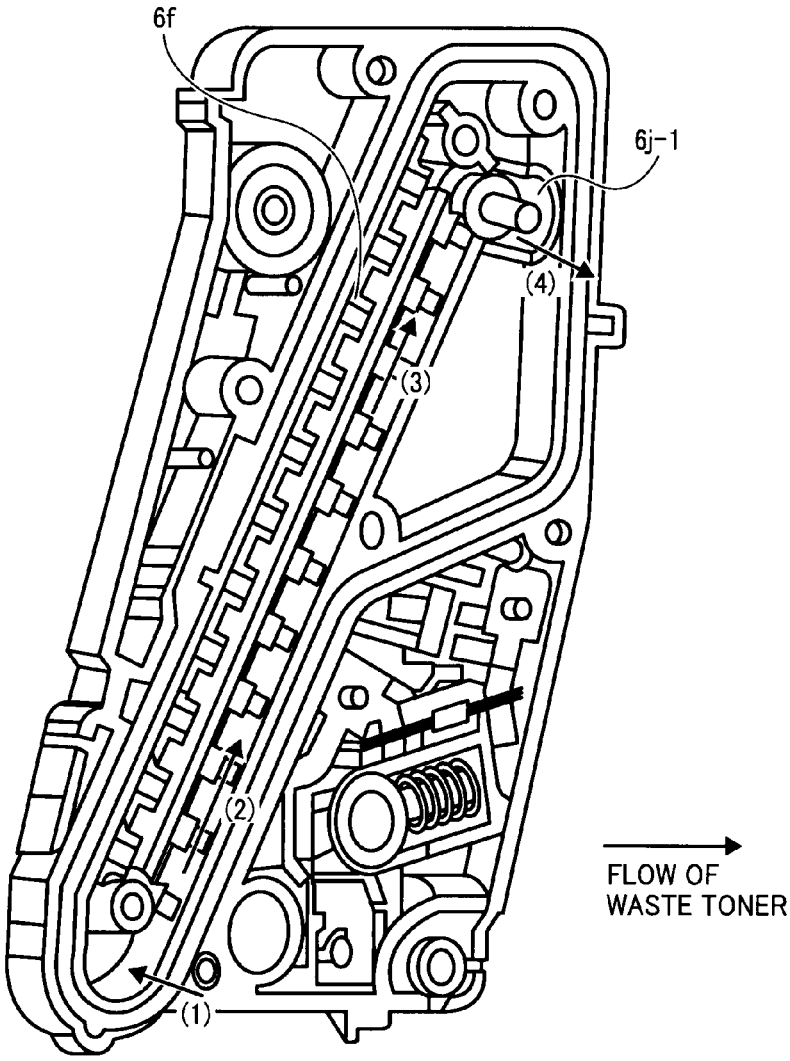
FIGS. 3A, 3B, 4A and 4B are schematic diagrams of a toner conveying device.
Figure 3B:
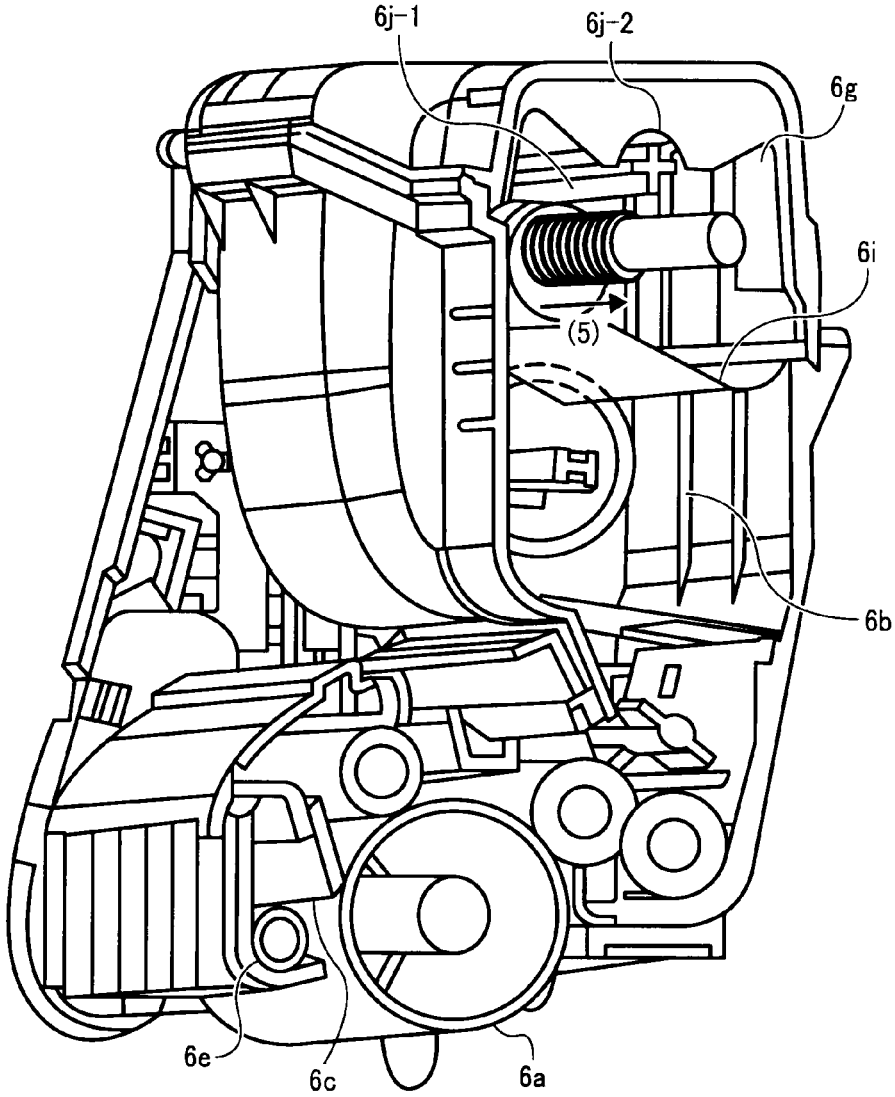

As shown in FIGS. 3A and 3B, the cleaning blade 6*c* removes residual toner from the photosensitive element 6*a*. The toner conveying screw 6*e* sends the removed toner as waste toner in a direction of an arrow (1) to the waste-toner conveying belt 6*f*. The waste-toner conveying belt 6*f* conveys the waste toner in directions of arrows (2) and (3). Next, the waste-toner conveying screw 1 (6*j*-1) conveys the waste toner in directions of arrows (4) and (5) into the waste-toner hopper 6*g*. The waste toner accumulates first on a side indicated by the arrow (5), and then sent to an free space by the waste-toner conveying screw 2 (6*j*-2). The flexible partition 6*i* deforms downward as shown in FIG. 4B to efficiently accommodate waste toner, thereby achieving space saving. Examples of material of the flexible partition 6*i* include polyurethane (PUR) and PUR foam.

Figure 4A:
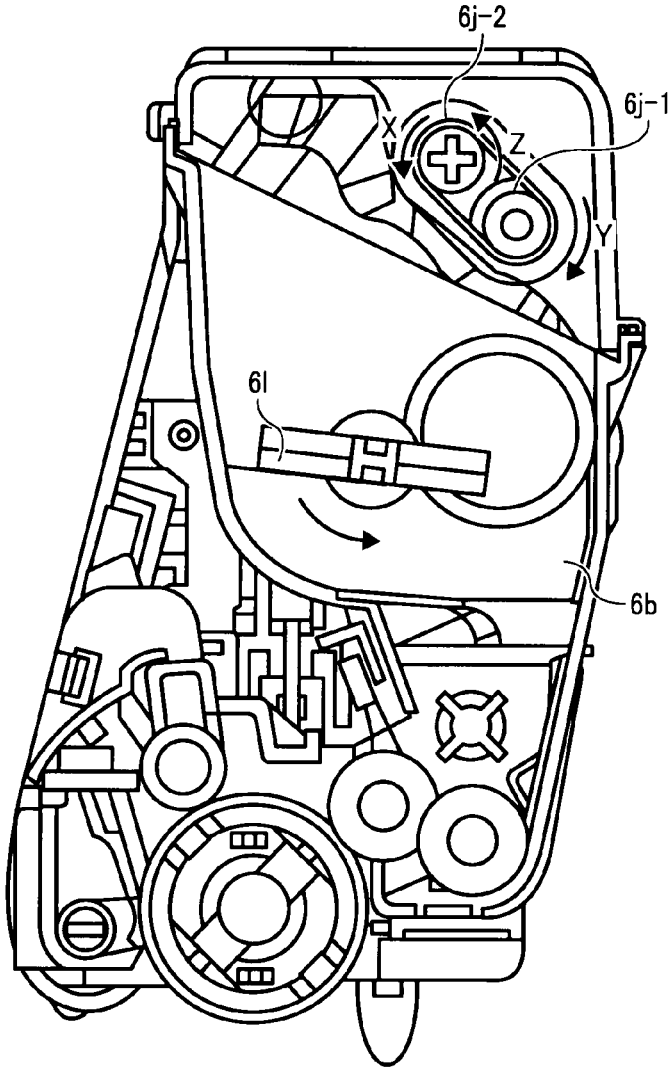
Figure 4B:
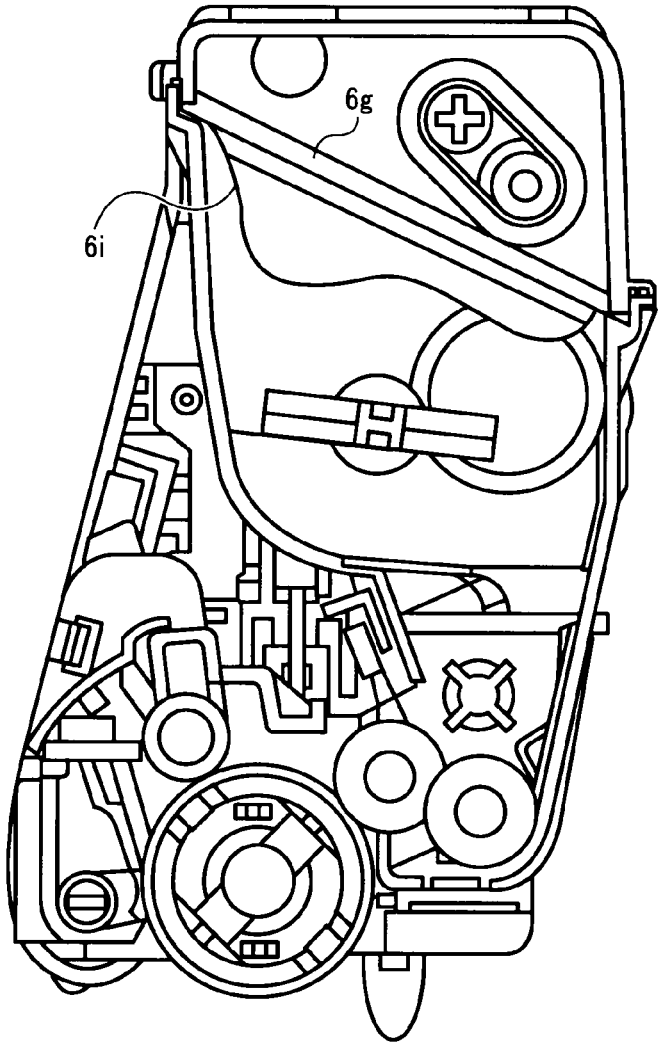

As shown in FIG. 4A, in an initial state where the toner hopper 6*b* is fully filled with unused toner, the internal pressure of the toner hopper 6*b* increases due to rotational stirring by an agitator 6*l*. As a result, the flexible partition 6*i* expands. Accordingly, the flexible partition 6*i* contacts the waste-toner conveying screws 1 and 2 (6*j*-1, 6*j*-2), which increases the torque of the conveying screws, and causes banding and the like. In addition, since the waste-toner conveying screws 1 and 2 (6*j*-1, 6*j*-2) rotates in a Y direction and an X direction, respectively, the flexible partition 6*i* is likely to be caught in the screws 1 and 2 (6*j*-1, 6*j*-2) in a Z direction. When this happens, rotation is locked, resulting in a serious failure.

Figure 5A:
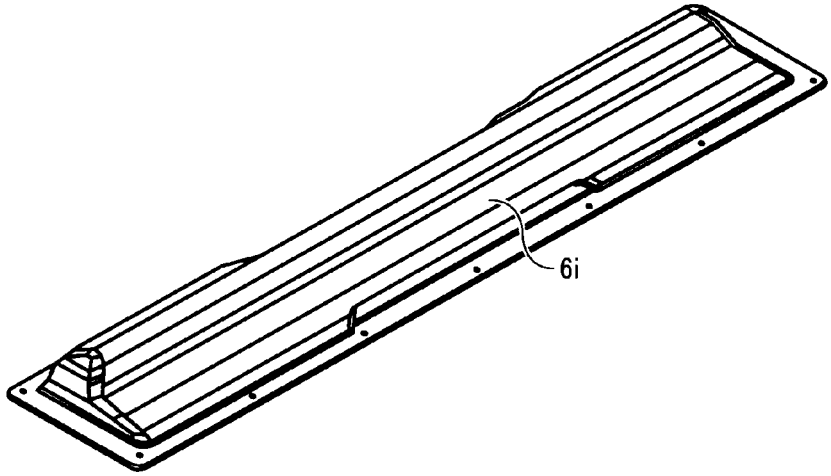
FIGS. 5A and 5B are schematic diagrams of a partition shown in FIG. 2.
Figure 5B:
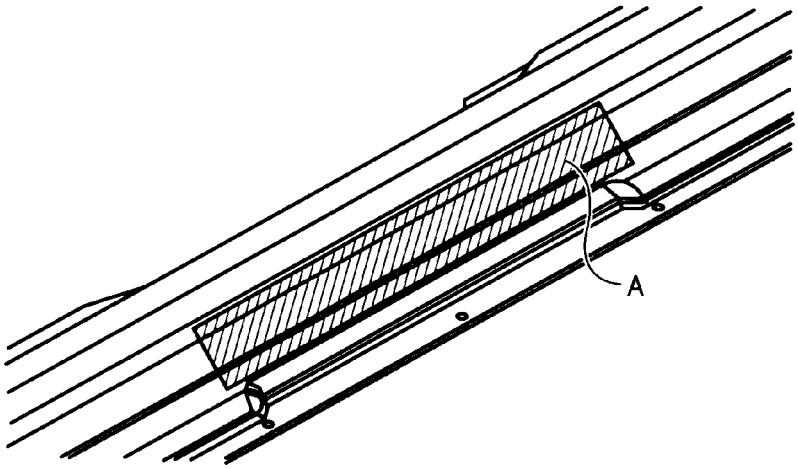

FIG. 5A is a schematic diagrams of the flexible partition 6*i*. FIG. 5B is a schematic diagrams of the flexible partition 6*i* provided with a polyethylene terephthalate (PET) member as a rigid body. The flexible partition 6*i* is formed with PUR foam by thermal compression molding. As shown in FIG. 5B, by providing a rigid body in an area A of the flexible partition 6*i* that contacts the waste-toner conveying screws 1 and 2 (6*j*-1, 6*j*-2), distortion thereof is prevented. Thus, the flexible partition 6*i* does not contact the waste-toner conveying screws 1 and 2 (6*j*-1, 6*j*-2). Even if the flexible partition 6*i* contacts the waste-toner conveying screws 1 and 2 (6*j*-1, 6*j*-2), the flexible partition 6*i* is not to be caught because of the rigid body. The rigid body can be formed of resin such as acrylonitrile butadiene styrene (ABS), polystyrene (PS), and polycarbonate (PC), preferably a sheet of polyethylene terephthalate (PET) for effective use of space, easy attachment, and cost reasons.

Figure 6:
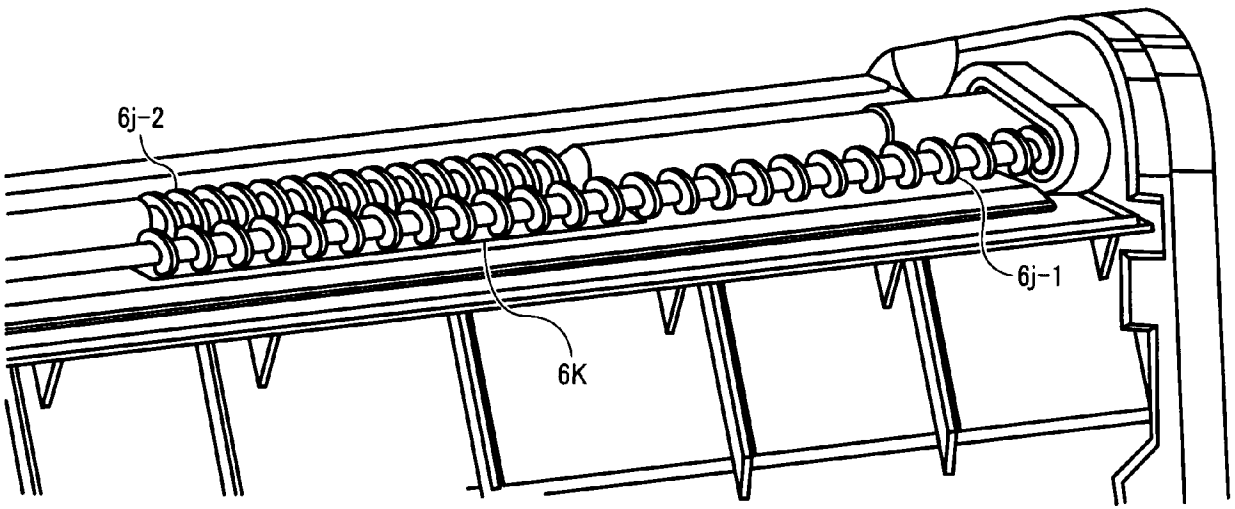
FIG. 6 is a schematic diagram of waste-toner conveying screws shown in FIG. 4A.

FIG. 6 is a schematic diagram of the waste-toner conveying screws 1 and 2 (6*j*-1, 6*j*-2) after the flexible partition 6*i* is provided with a PET member. In this example, the PET member is attached to the flexible partition 6*i* with double-face tape. With this, even when the waste-toner conveying screws 1 and 2 (6*j*-1, 6*j*-2) rotate, the PET member is not caught in the screws 1 and 2 (6*j*-1, 6*j*-2). Furthermore, since the coefficient of friction on the surface of resin is lower than that on the surface of PUR or PUR foam, the torque does not increase.

Figure 7:
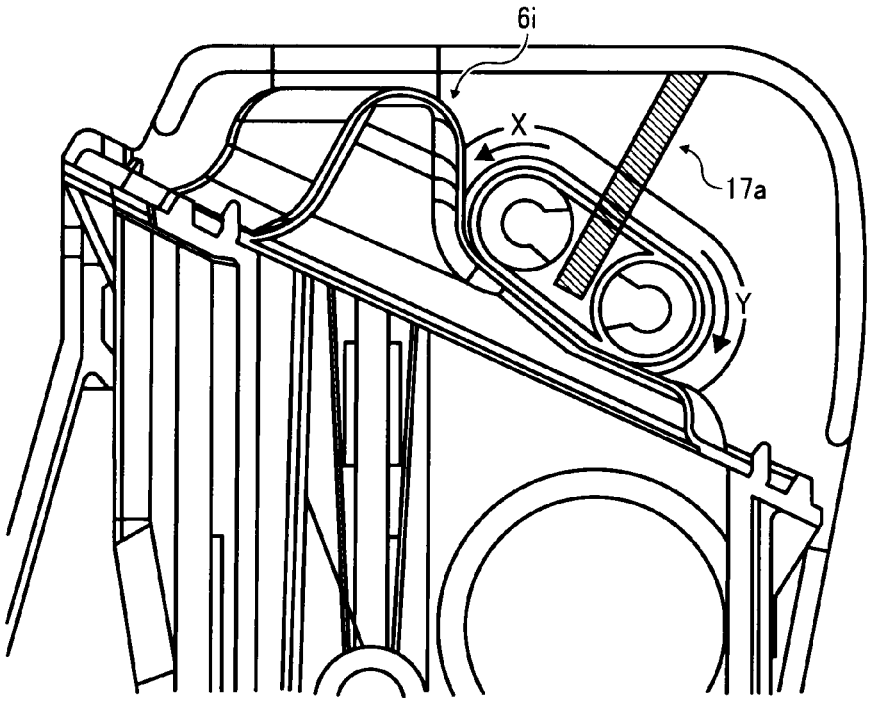
FIG. 7 is a schematic diagram of an upper portion of the toner conveying device.

FIG. 7 is a schematic diagram of an upper portion of the toner conveying device. As shown in FIG. 7, a reinforcing rib 17*a* is provided in an upper casing of the toner conveying device. By arranging the reinforcing rib 17*a* between the waste-toner conveying screws 1 and 2 (6*j*-1, 6*j*-2), the flexible partition 6*i* is prevented from being caught between the waste-toner conveying screws 1 and 2 (6*j*-1, 6*j*-2).

One approach to preventing the torque from increasing and the flexible partition 6*i* from being caught is to reduce the coefficient of friction at the time of contact between the waste-toner conveying screws 1 and 2 (6*j*-1, 6*j*-2) and the flexible partition 6*i*. The coefficient of friction can be reduced by applying KYNAR (polyvinylidene fluoride) or toner to the waste-toner conveying screws 1 and 2 (6*j*-1, 6*j*-2) or the flexible partition 6*i*.

By sliding a partition applied with PS, i.e., material the same as that of screws, frictional force was measured by a digital force gauge. The measurement was conducted for three cases: when there is nothing between the partition and PS, when PET (Lumirror S10) is interposed therebetween, and when toner is interposed therebetween, under the following conditions:

Planar piece: 35 mm×20 mm, 280 grams

Material: PS (the same as that of the waste-toner conveying screws 1 and 2 (6*j*-1, 6*j*-2))

Environment: 23° C. 50% RH

The following is a table of the results of the measurement.

TABLE 1

Results of friction force measurement

| | Partition | PET Lumirror S10 | Unit (N) Toner applied FS |
|---|---|---|---|
| First time | 2.5 | 1.1 | 1.4 |
| Second time | 2.4 | 1.3 | 1.6 |
| Third time | 2.9 | 1.3 | 1.6 |
| Average | 2.6 | 1.23 | 1.53 |
| Friction Coefficient Ratio | M | 0.47μ | 0.59μ |

When PET is interposed between the partition and PS, the coefficient of friction can be lowered by 53%, and when toner is applied, the coefficient of friction can be lowered by 41%.

If the waste-toner conveying screws 1 and 2 (6*j*-1, 6*j*-2) that rotate in the directions Y and X as shown in FIG. 4, respectively, are rotated reversely to push out the partition, it is effective to prevent the partition from being caught in the screws 1 and 2 (6*j*-1, 6*j*-2). In this case, it is necessary to be careful about the partition being caught between the waste-toner conveying screws 1 and 2 (6*j*-1, 6*j*-2) and a sidewall of the casing.

As described above, according to an embodiment of the present invention, a toner conveying device includes waste-toner conveying members that convey waste toner in a waste-toner hopper. The waste-toner hopper is separated from an unused-toner hopper by a flexible elastic member as a partition. A rigid body is provided on the flexible partition that is arranged near the waste-toner conveying members. The rigid body can prevent the flexible partition from directly contacting the waste-toner conveying members (screws). Thus, the torque can be prevented from increasing, and the flexible partition can be prevented from being caught in the waste-toner conveying members.

Moreover, by making the coefficient of friction on the surface of the rigid body smaller than that of the flexible partition, the torque can be prevented from increasing, and the flexible partition can be prevented from being caught in the waste-toner conveying members even if the rigid body contacts the waste-toner conveying members. With the use of a PET resin sheet as the rigid body, space can be effectively used and cost can be reduced.

To reduce the coefficient of friction, KYNAR (polyvinylidene fluoride) or toner can be applied to either one of the waste-toner conveying members and the flexible partition. By providing a pressing member between the waste-toner conveying members, it is possible to prevent the flexible partition from being caught in the waste-toner conveying members. The pressing member can be a rib that also increases rigidity of a casing. This prevents the flexible partition from being caught without increasing cost. If the waste-toner conveying members are rotated in such directions that the flexible partition is pushed out, the flexible partition can also be prevented from being caught in the waste-toner conveying members.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner conveying device, comprising:

a first container that contains unused toner;

a second container that contains waste toner;

a first conveying member that is located inside the second container, and conveys waste toner;

a second conveying member; and a flexible partition made of elastic material that is located near the first conveying member, and separates the first container and the second container, the flexible partition including a rigid body, wherein the first conveying member and the second conveying member rotate in directions opposite to each other such that the flexible partition is pushed out from an area in which the first conveying member and the second conveying member face each other.

2. The toner conveying device according to claim 1, wherein a coefficient of friction on a surface of the rigid body is smaller than a coefficient of friction of the flexible partition.

3. The toner conveying device according to claim 1, wherein the rigid body is a polyethylene terephthalate resin sheet.

4. A process cartridge comprising the toner conveying device according to claim 1.

5. An image forming apparatus comprising the toner conveying device according to claim 1.

6. A toner conveying device comprising:

a first container that contains unused toner;

a second container that contains waste toner;

a plurality of conveying members that are located inside the second container, and convey waste toner;

a flexible partition made of elastic material that is located near at least one of the conveying members, and separates the first container and the second container; and a pressing member that is located between the conveying members to prevent the flexible partition from being caught in the conveying members, wherein toner is applied in advance of a first use to either one of the conveying member and the flexible partition.

7. The toner conveying device according to claim 6, wherein the pressing member is a rib that reinforces rigidity of a casing of the toner conveying device.

8. The toner conveying device according to claim 6, wherein a first conveying member and second conveying member of the plurality of conveying members rotate in directions opposite to each other such that the flexible partition is pushed out from an area in which the first conveying member and the second conveying member face each other.

9. A process cartridge comprising the toner conveying device according to claim 6.

10. An image forming apparatus comprising the toner conveying device according to claim 6.

11. An image forming apparatus comprising the process cartridge according to claim 9.

* * * * *